US005824937A

United States Patent [19]

Szalay

[11] Patent Number: 5,824,937

[45] Date of Patent: Oct. 20, 1998

[54] SIGNAL ANALYSIS DEVICE HAVING AT LEAST ONE STRETCHED STRING AND ONE PICKUP

[75] Inventor: Andreas Szalay, Emmelshausen, Germany

[73] Assignees: Yamaha Corporation, Japan; Blue Chip Music GmbH, Germany

[21] Appl. No.: 624,528

[22] PCT Filed: Nov. 26, 1994

[86] PCT No.: PCT/EP94/03917

§ 371 Date: Apr. 11, 1996

§ 102(e) Date: Apr. 11, 1996

[87] PCT Pub. No.: WO95/16984

PCT Pub. Date: Jun. 22, 1995

[30] Foreign Application Priority Data

Dec. 18, 1993 [DE] Germany ..... 43 43 411.8

[51] Int. Cl.[6] ..... G10H 3/18

[52] U.S. Cl. ..... 84/654; 84/653; 84/726; 84/731; 706/20

[58] Field of Search ..... 395/22; 84/726, 84/731, 723, 647, 653, 654; 706/20, 16

[56] References Cited

U.S. PATENT DOCUMENTS

| | | | |
|---|---|---|---|
| 4,151,775 | 5/1979 | Deutsch et al. | 84/603 |
| 4,351,216 | 9/1982 | Hamm | 84/726 |
| 4,823,667 | 4/1989 | Deutsch et al. | 84/730 |
| 4,841,827 | 6/1989 | Uchiyama | 84/622 |
| 4,991,488 | 2/1991 | Fala et al. | 84/731 |
| 5,048,391 | 9/1991 | Uchiyama et al. | 84/654 |
| 5,138,924 | 8/1992 | Ohya et al. | 84/604 |
| 5,308,915 | 5/1994 | Ohya et al. | 84/601 |

FOREIGN PATENT DOCUMENTS

| | | | |
|---|---|---|---|
| 0 227 906 A2 | 7/1987 | European Pat. Off. | G10H 3/18 |
| 0 288 062 A2 | 10/1988 | European Pat. Off. | G10H 3/18 |

OTHER PUBLICATIONS

EEA (Science Abstracts) 1992, No. 1, S. 456 No. 6057.

EEA (Science Abstracts) 1992, No. 4, S. 1988 No. 25387.

*Primary Examiner*—Allen R. Macdonald
*Assistant Examiner*—Jason W. Rhodes
*Attorney, Agent, or Firm*—Graham & James LLP

[57] ABSTRACT

A signal analysis device for determining the pitch of a plucked string in which propagation times of plucking transients are evaluated to determine pitch. A neural network may be employed to perform evaluation based upon groups of pulses.

8 Claims, 2 Drawing Sheets

SIGNAL ANALYSIS DEVICE HAVING AT LEAST ONE STRETCHED STRING AND ONE PICKUP

BACKGROUND OF THE INVENTION

1. Field of the Invention

The invention relates to a signal analysis device having at least one stretched string whose oscillatory length can be varied by resting it on at least one fret, having a pickup and having an evaluation device connected to the pickup.

A signal analysis device of this type can also be briefly designated as a "guitar synthesizer."

In the modern pop and rock music, there is an increasing trend no longer to use musical instruments directly for the production of notes or sounds, but just to produce or analyze and convert electric signals, which are further processed by computers or other circuits. For this purpose, there are standardized interfaces of which the MIDI interface has become relatively well known.

While a signal production or signal analysis of this type is accompanied by relatively few difficulties in the case of keyboard musical instruments, since in this case each key has assigned to it precisely one pitch and the volume can, if appropriate, be determined via the speed of attack of the key, signal analysis in the case of stringed instruments, for example guitars, presents considerable difficulties. In the case of stringed instruments of this type, although each string has a fundamental note assigned to it, by pressing down the string on various pick-offs or frets, the pitch of a plucked, struck or otherwise excited string can be varied. In order to determine the correct pitch, it is necessary firstly to wait for the formation of such a note and then to measure the frequency or duration of at least one, but preferably more than one, period, in order to be able to discover the pitch with the necessary reliability.

2. Description of the Prior Art

U.S. Pat. No. 4,823,667 therefore shows a signal analysis device as an electronic musical instrument which is actuated in the manner of a guitar, in which a frequency analyzer which determines the frequency of the excited string is provided. However, a procedure of this type leads to problems in relation to time. In the case of a normal guitar, the lowest note has a frequency of about 80 Hz (exactly: 82 Hz), so that one complete oscillation needs a time of about 12.5 ms. Since, for reasons of certainty, it is normally desired to measure two oscillations in order to draw reliable conclusions, the time which is necessary already adds up to 25 ms. In this case, it has not yet been taken into account that the string still needs a certain time after the excitation, for example by means of plucking or striking, to pass into the steady state. For this purpose, as a rule a non-negligible interval is likewise to be added, which may well amount to twice a period length, so that the desired pitch information is available only after 50 ms. A time delay of 50 ms, however, is already distinctly noticeable to a musician. It corresponds to the setting up of the loudspeaker box at a distance of approximately 15 m.

As an alternative possible solution for this problem, therefore, in U.S. Pat. No. 5,085,119 there are provided on the neck of the guitar switches which are activated when the corresponding string is pressed down onto the desired fret. However, precisely as in the case of a keyboard instrument, the pitch information is no longer obtained by the string oscillation but by pressing down a switch. This makes playing considerably more difficult.

SUMMARY OF THE INVENTION

The invention is based on the object of being able to obtain the pitch information more rapidly in the case of a guitar synthesizer.

This object is achieved in the case of a signal analysis device of the type mentioned at the outset in that the evaluation device registers pulses or groups of pulses which run on the string past the pickup after an excitation of the string and, on the basis of the time sequence of the pulses or of the groups of pulses, produces a signal which represents a pitch.

One therefore no longer waits until an oscillation has been built up on the string and is then measured, but rather evaluates so-called "plucking transients", that is to say pulses or pulse trains which result from the excitation of the guitar string. If a guitar string is plucked or struck, in the simplest case two pulses or traveling waves are produced, which move from the point of excitation in the direction of the clamping points of the string and, respectively, of the point where the string is pressed down onto the fret. There, they are reflected and run toward each other once more. After running to and fro several times, the known standing wave is then formed, which is normally responsible for the note production. However, it is also possible to measure the propagation time of these pulses on the string or to evaluate it and, from the propagation time or, respectively, the difference in propagation times between individual pulses, to obtain the necessary information about the string length and string tension and thus about the pitch. Of course, in actual fact individual pulses do not form, but rather groups of pulses. However, this does not change anything concerning the principle on which the invention is based.

Preferably, the evaluation device also registers the polarity of the pulses or groups of pulses and, from the time sequence of the pulses or groups of pulses, determines a signal which represents the position of excitation of the string. The position of excitation of the string, that is to say the position at which the string is plucked or struck or set into motion in another way, is one of the great possible means by which the player can use an individual style when playing the guitar. Since two pulses or groups of pulses are available, which move away from the position of excitation in opposite directions on the string and are reflected with corresponding time delays at the respective clamping positions of the strings, on the basis of the different propagation times of the pulses it is also possible to obtain information as to where the position of excitation was located. This information is obtained virtually as rapidly as the information about the pitch, so that the determination of the position of excitation does not mean any further time delay.

The evaluation device preferably comprises a neural network which classifies each sequence of pulses or groups of pulses into one of a multiplicity of classes. The sequences of pulses or groups of pulses, which are to be assigned to a specific pitch, in each case have significant commonalities, which a neural network can discover relatively easily. It is possible here to be satisfied with similarities between the individual pulse sequences or sequences of groups of pulses, without having to evaluate each sequence of pulses exactly with respect to time. The precise evaluation with respect to time can occasionally be accompanied by difficulties if the pulses are not present in the desired purity but are surrounded by disturbing noise. In this case, it can occasionally become difficult to define exact start and finish times for the allocation of the intervals of individual pulses or groups of pulses. On the other hand, a neural network can be programed in such a way that it makes the decision as to which pitch is present and at which position the string has been excited simply on the basis of similarities. Here, a neural network has the advantage that it does not necessarily need explicitly specified rules in accordance with which it assesses the similarities. Rather, a neural network can be trained, that is to say, as the result of the presentation of a multiplicity of examples having the correct results, it forms algorithms or controlled responses for itself, which make it capable of correctly classifying subsequent examples. Furthermore, a neural network can to a certain extent make generalities, forming the rules for the generalities itself. The neural network is therefore in a position to detect sequences of pulses or sequences of groups of pulses relatively precisely even if the sequence of pulses presented to it does not exactly coincide with an already trained sequence of pulses. Since neural networks as a rule are constructed with a multiplicity of processors operating in parallel, they are sufficiently fast to make the pitch signal available in the required short time span.

It is also preferred that the evaluation device comprises a comparison device which compares a pitch signal obtained from the string in the steady state with the signal obtained from the sequence of pulses and, in the event of a deviation which exceeds a predetermined amount, triggers a learning algorithm of the neural network. The evaluation device therefore does not restrict the pitch identification to the evaluation of the "plucking transients". Rather, this evaluation is only the beginning, which nevertheless makes it possible to make the pitch signal available within the shortest time. The evaluation device also monitors whether the signal detected agrees with the pitch which later builds up in the oscillating string. If this is so, the "prediction" was correct and no further measures are necessary. If the "prediction" was wrong, however, there is a certain probability that the algorithm in accordance with which the neural network has assessed the similarity was erroneous. In this case, the result of the comparison can be used to make a further training example available to the neural network. On the basis of this training example, the neural network can learn anew and improve its identification algorithm.

Preferably, there is connected upstream of the neural network a selection device which selects individual pulses from a group of pulses. This is particularly of advantage if the neural network provides only a restricted operating capacity. In this case, the quantity of information which the neural network must process can be kept smaller by means of a corresponding preselection.

A dedicated pickup is preferably provided for each string. This allows a parallel sound signal production for each string to be realized, without confusion of the evaluation device being able to occur as a result of the plucking transients, that is to say the pulses running to and fro, which are different for all the strings.

BRIEF DESCRIPTION OF THE DRAWINGS

The invention is described in the following text with reference to a preferred exemplary embodiment, in conjunction with the drawing, in which.

DESCRIPTION OF THE PREFERRED EMBODIMENT

Figure 1:
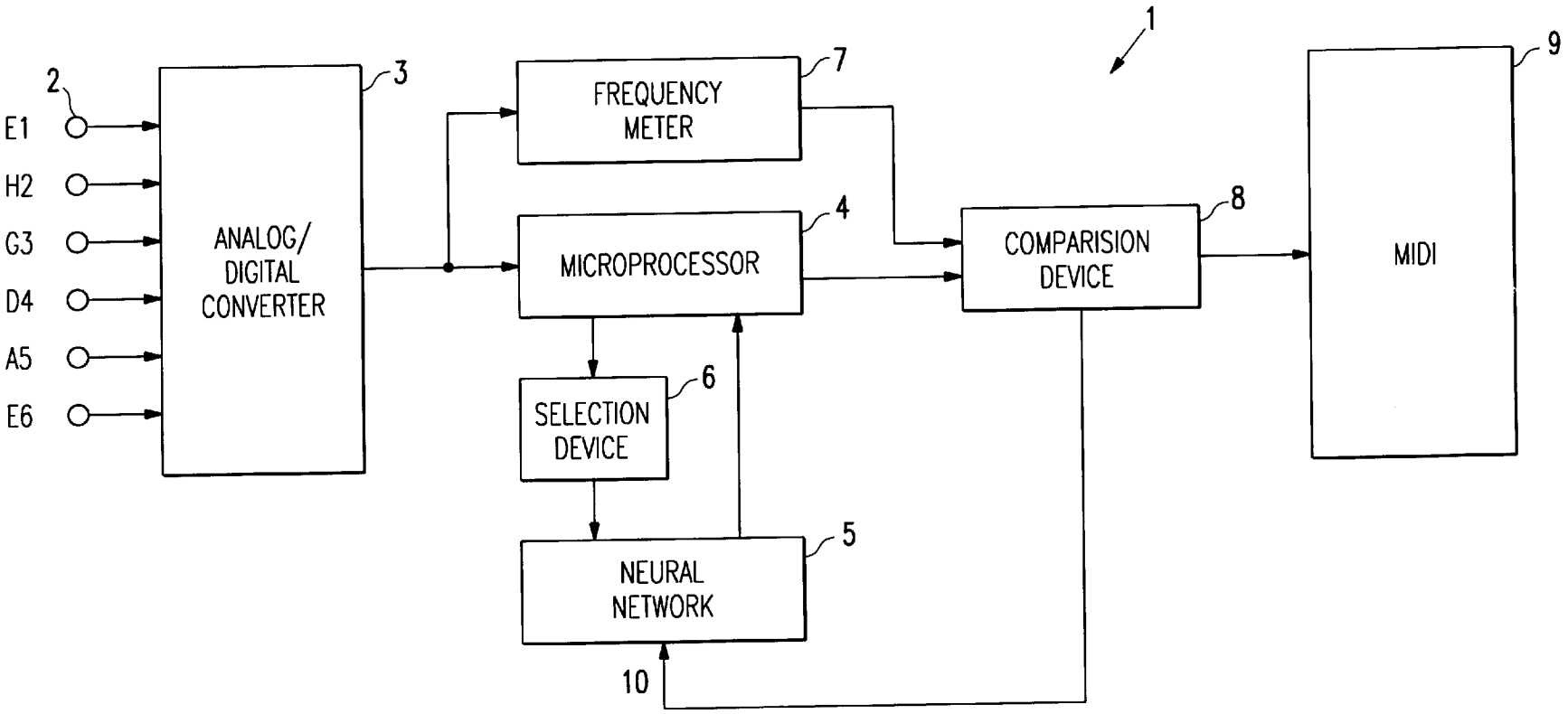
FIG. 1 shows a schematic representation of a signal analysis device.

A signal analysis or production device 1 has six strings E1, H2, G3, D4, A5 and E6, which are strung in the manner of a guitar. Provided for each string is a pickup 2 which, for example, can be constructed as an electromagnetic or piezoelectric sound pickup. The pickups 2 are connected to an analog/digital converter 3 which, in the exemplary embodiment shown, has one channel for each pickup 2, that is to say is designed with six channels.

The analog/digital converter 3 is connected to a microprocessor 4 which provides the input and output management for a neural network 5. A selection device 6 can also be provided between the microprocessor 4 and the neural network 5, the function of which selection device will be described later.

Moreover the analog/digital converter 3 is connected to a frequency meter 7. The frequency meter 7 and the microprocessor 4 are connected to a comparison device 8. The comparison device 8 is connected to a MIDI interface 9. The comparison device 8 is likewise connected to the neural network 5, to be specific to a learning input 10.

Under the management of the microprocessor 4 and, if appropriate, conditioned by the selection device 6, the neural network 5 receives a sequence of pulses or groups of pulses and classifies these sequences in each case into one of a multiplicity of specific classes. Here, each class allows a conclusion as to the pitch and, if appropriate, also as to the position of excitation of the string, as will be explained in the following text.

Figure 2:
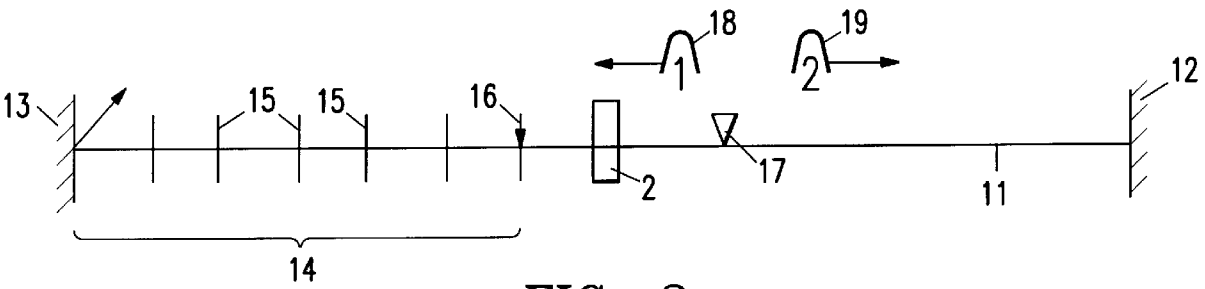
FIG. 2 shows a schematic structure of a string.

FIG. 2 shows schematically a string 11 which is strung between a fixed clamping point 12 and a clamping point 13 at which the tension can be set. The string 11 stretches over a guitar neck 14 on which there are arranged various frets 15. Shown by an arrow 16 is one fret, on which the string 11 is pressed down. This fret 16, together with the clamping point 12, determines the effective length of the string 11. The pertinent pickup 2 is arranged under the string.

By means of a triangle 17, which is intended to symbolize a plectrum or a similar plucking implement, a position of excitation for the string 11 is shown. If the string 11 is now plucked or struck at this position of excitation, a standing wave of the frequency which is characteristic of the pitch is not established directly. Rather, a transient process begins, which can be described in a simplified way by saying that two pulses 18, 19 run to the left and to the right from the position of excitation. These pulses or traveling waves are differentiated from each other by a drawn-in 1 and a drawn-in 2. The pulse 18 now runs to the left as far as the fret 16, on which the string is held down. There it is reflected, with phase reversal, and runs back once more. In the same way the pulse 19 runs to the right as far as the clamping point 12, where it is reflected, with phase reversal, and runs back once more. The pulses or waves, running to and fro, overlay one another and after a short time form the known standing wave with which the string 11 oscillates.

Figure 3:
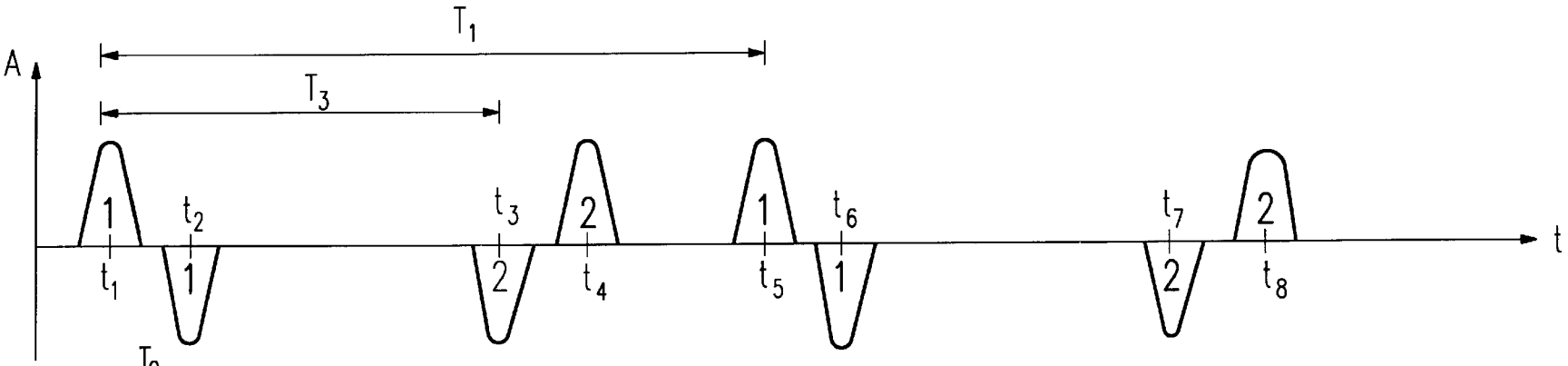
FIG. 3 shows a schematic representation of a signal variation.

However, the pulses 18, 19 run past the pickup 2. A corresponding time diagram is shown in FIG. 3. It can be seen here that the first pulse, which is intended to have a positive amplitude, crosses the pickup at a time t1, while its reflection, now having a negative amplitude, crosses the pickup at a time t2. At a time t3, the second pulse, reflected at the clamping point 12, reaches the pickup, while it runs over the pickup 2 once more at a time t4. This is then the second pulse reflected for the second time, specifically at the fret 16. At the times t5 and t6, the first pulse, which has then been reflected at the clamping point 12 and at the fret 16, runs once more over the pickup 2 and, at the times t7 and t8, the second pulse, which has then been reflected once more at the clamping point 12 and at the fret 16, runs over the pickup 2.

The velocity of motion or traveling velocity of the pulses 18 or 19 on the string 11 is known. The active length of the string 11 can now be determined from the time difference T1, which is the difference between the times t5 and t1, with the aid of this traveling velocity. However, this is also the length which is responsible for the pitch of the string 11. Providing that the distance of the pickup 2 from the fret 16 and from the frets 15 is known, the distance T2, that is to say the interval between the times t2 and t1, would in principle also be sufficient. However, this relinquishes the possibility of fine tuning, since the guitarist has the possibility of varying the pitch by means of slight displacements of his finger on the frets 15,16. Moreover, the pulses cannot be distinguished so clearly in many cases, as is shown in FIG. 3 for reasons of simplicity. Rather, blurring of the individual pulses can occur, in particular if, when the string 11 is plucked or struck, individual pulses, as shown, are not produced, but rather whole groups of pulses.

However, in almost all cases, conclusions can be drawn as to the position of the excitation from the time difference T3, that is to say from the difference between the times t3 and t1. If, from the difference T1, the string length is known, it is possible to calculate back from the difference T3 to find at which fraction of the string the excitation has taken place.

Nevertheless, the measurement of time for determining the interval between the pulses shown is occasionally subject to uncertainties. For this reason, using the selection device 6, individual pulses are selected from the sequence of groups of pulses which are registered by the pickups 2 and said individual pulses are fed to the neural network 5. The neural network can identify similarities between individual sequences of groups of pulses and classify the "plucking transients", which are represented by these sequences of pulses, in such a way that their assignment to individual classes, which in each case reproduce a pitch and a position of excitation, is possible with great certainty. The identification sequence is triggered here by the occurring pulses. The successive positive and negative pulses or groups of pulses are forwarded to the neural network, which tries on each occasion to assign the pattern picked up or the sequence picked up to a previously learned sequence. This detection sequence is repeated until either the neural network has produced a positive result or the frequency meter 7 has provided the corresponding information. If the neural network is still in the learning or training phase, in many cases the frequency meter will be quicker. However, after a certain training phase, the neural network 5, which can itself form the rules for the identification if it is programed accordingly, has stored sufficient information to be able to undertake the classification itself in an extraordinarily effective manner. The neural network 5 also forms specific rules for generalities, so that even patterns which have not been learned specifically can be identified, providing these have specific similarities to the examples already learned.

Since the frequency meter undertakes a pitch identification in parallel, further learning is also possible during the operation of the signal analysis device 1. The comparison device 8 compares the pitch determined by the neural network 5 with one determined later by the frequency meter 7. Here, it is possible on the one hand to follow the fine pitch changes, which are a means of expression of the player, on the other hand, using this procedure, errors or inaccuracies in the algorithm which is applied by the neural network 5 can be discovered and eliminated. The comparison device 8 specifically couples the determined error back into the neural network 5 and triggers a new learning algorithm, so that the same error cannot occur again, as a result of the improved identification capability. In the event that no difference occurs, the comparison device 8 forwards the signal or signals unchanged to the MIDI interface 9.

The output results of the neural network are processed further in such a way that the MIDI interface 9 can make MIDI signals available, which can drive a MIDI synthesizer or an expander module. The pitch encoded in the MIDI signal corresponds in this case to the pitch of the guitar string. Moreover, the plucking position can also be contained in the MIDI signal as monitoring information, as an encoded sound quality character.

I claim:

1. A signal analysis device for at least one stretched string whose oscillatory length can be varied by resting it on at least one fret, comprising:

a pickups and an evaluation device connected to the pickup, wherein the evaluation device (a) registers pulses or groups of pulses, formed as plucking transients, which run on the string past the pickup in response to excitation of the string by plucking or striking by a player (b) determines at least one propagation time of said pulses or groups of pulses on the string and, (c) on the basis of the propagation time or of differences in propagation times between individual pulses or groups of pulses produces a signal which represents a pitch.

2. The device as claimed in claim 1, wherein the evaluation device also registers the polarity of the pulses or groups of pulses and, from the time sequence of the pulses or groups of pulses, determines a signal which represents the position of excitation of the string.

3. The device as claimed in claim 2, wherein the evaluation device comprises a neural network which classifies each sequence of pulses or groups of pulses into one of a multiplicity of classes.

4. The device as claimed in claim 1, wherein the evaluation device comprises a neural network which classifies each sequence of pulses or groups of pulses into one of a multiplicity of classes.

5. The device as claimed in claim 4, wherein the evaluation device comprises a comparison device which compares a pitch signal obtained from the string in the steady state with the signal obtained from the sequence of pulses and, in the event of a deviation which exceeds a predetermined amount, triggers a learning algorithm of the neural network.

6. The device as claimed in claim 5, wherein there is connected upstream of the neural network a selection device which selects individual pulses from a group of pulses.

7. The device as claimed in claim 4, wherein there is connected upstream of the neural network a selection device which selects individual pulses from a group of pulses.

8. The device as claimed in claim 1, wherein a dedicated pickup is provided for each string.

* * * * *